US005671959A

United States Patent [19]

Tsou

[11] Patent Number: 5,671,959

[45] Date of Patent: Sep. 30, 1997

[54] REFUSE COLLECTING DEVICE

[76] Inventor: Eric Tsou, No. 9, Lane 83, Sec. 1, Kungfu Road, Sanchung City, Taiwan

[21] Appl. No.: 733,958

[22] Filed: Oct. 21, 1996

[51] Int. Cl.[6] ..... A01K 29/00; E01H 1/12

[52] U.S. Cl. ..... 294/1.4; 15/257.6

[58] Field of Search ..... 294/1.3–1.5, 19.1, 294/22, 24, 50.8, 50.9, 55, 115; 15/104.8, 257.1, 257.4, 257.6, 257.7; 119/161, 165

[56] References Cited

U.S. PATENT DOCUMENTS

| | | | |
|---|---|---|---|
| 4,641,873 | 2/1987 | Nurnberger | 294/1.4 |
| 5,320,393 | 6/1994 | Cortinas | 294/1.4 |
| 5,540,470 | 7/1996 | Lu | 294/1.4 |

*Primary Examiner*—Johnny D. Cherry
*Attorney, Agent, or Firm*—Ostrolenk, Faber, Gerb & Soffen, LLP

[57] ABSTRACT

A refuse collecting device includes an elongated tube having an inner cylinder slidably received in the upper portion and a bag mount having a half moon shaped frame with a cylindrical section slidably received within the lower end of the tube in a spring-loaded manner. A bag is releasably mounted to the mount by having one side attached to the mount and an opposite side attached to the tube and being expanded by the spring. A paddle is rotatably mounted to the tube to correspond to the half moon frame and movable relative thereto to cover/discover the frame that expands the bag. A grip in the form of a hollow cylinder fit over the tube is coupled to the inner cylinder so to be manually movable along the tube to move the inner cylinder inside the tube. A transverse positioning pin extends through slots formed on the inner cylinder to be moved thereby. A first wire connects the paddle to the positioning pin and has a first slack. A second wire connects the mount to the positioning pin and has a second slack. The second slack is greater than the first slack so that the open operation of the paddle and the release of the bag can be performed by a single hand moving the inner cylinder via the grip to travel different distance. A two stage positioning control device may be provided to secure the positions of the positioning pin.

20 Claims, 5 Drawing Sheets

REFUSE COLLECTING DEVICE

FIELD OF THE INVENTION

The present invention relates to a refuse collecting device and in particular to a device which has a movable paddle to scoop refuses, particularly pet dropping, into a bag which is then released and disposed in a sanitary manner.

BACKGROUND OF THE INVENTION

Devices for scooping animal feces into a releasable bag are known, such as U.S. Pat. No. 5,320,393, which discloses an elongated tubular handle within which an inner tube is slidably received. The inner tube has an expanding means mounted to a lower end thereof to which a bag is releasably secured. The bag has one side attached to the expanding means and an opposite side supported on a sideways lug provided on the lower end of the handle. The inner tube is spring-biased to have the expanding means moved away from the sideways lug of the handle bar so as to expand and firmly secure the bag thereon. This opens the bag for the entry of refuse. A lid or paddle is rotatably fixed to the opening of the bag and manually operable for opening/closing the bag opening. The paddle is connected to a pin which is movable with the inner tube so that by moving the inner tube relative to the handle, the paddle is opened to receive the refuse into the bag. A disadvantage associated with this design is that the movement of the inner tube to open the paddle also de-expands the bag so that the bag may be un-desirably released.

To overcome such a problem, U.S. Pat. No. 5,540,470 teaches to provide a separate bag control mechanism which is separate from the mechanism for opening the paddle. This, although effective in overcoming the above discussed problem, requires both hands to operate.

Moreover, both U.S. patents teach no measure to protect the paddle from being contaminated or soiled by the animal dropping in the collecting operation.

It is therefore desirable to provide an improvement of the refuse collecting device over the prior art which allows the device to be operable by a single hand. Also, a paddle cover or enclosure is provided to releasably cover the paddle for protecting the paddle from being soiled by the refuse to be collected.

SUMMARY OF THE INVENTION

The principal object of the present invention is to provide a refuse collecting device which comprises a separate mechanism to secure the bag during the collecting operation so that no un-desired release of the bag may occur.

It is another object of the present invention to provide a refuse collecting device wherein a single control device is provided to operate both the opening/closing mechanism of the paddle and a separate bag securing mechanism so that the device is operable with a single hand.

It is a further object of the present invention to provide a refuse collecting device wherein a paddle cover is provided to protect the paddle from being soiled by the refuse to be collected.

In accordance with the present invention, there is provided a refuse collecting device comprising an elongated tube having an inner cylinder slidably received in the upper portion and a bag mount having a half moon shaped frame with a cylindrical section slidably received within the lower end of the tube in a spring-loaded manner. A bag is releasably mounted to the mount by having one side attached to the mount and an opposite side attached to the tube and being expanded by the spring. A paddle is rotatably mounted to the tube to correspond to the half moon frame and movable relative thereto to cover/discover the frame that expands the bag. A grip in the form of a hollow cylinder fit over the tube is coupled to the inner cylinder so to be manually movable along the tube to move the inner cylinder inside the tube. A transverse positioning pin extends through slots formed on the inner cylinder to be moved thereby. A first wire connects the paddle to the positioning pin and has a first slack. A second wire connects the mount to the positioning pin and has a second slack. The second slack is greater than the first slack so that the open operation of the paddle and the release of the bag can be performed by a single hand moving the inner cylinder via the grip to travel different distance. A two stage positioning control device may be provided to secure the positioning pin at desired positions corresponding to the different travel distances for opening the paddle and releasing the bag.

BRIEF DESCRIPTION OF THE DRAWINGS

The present invention will be better understood from the following description of a preferred embodiment thereof, with reference to the attached drawings, wherein.

DETAILED DESCRIPTION OF THE PREFERRED EMBODIMENT

Figure 1:
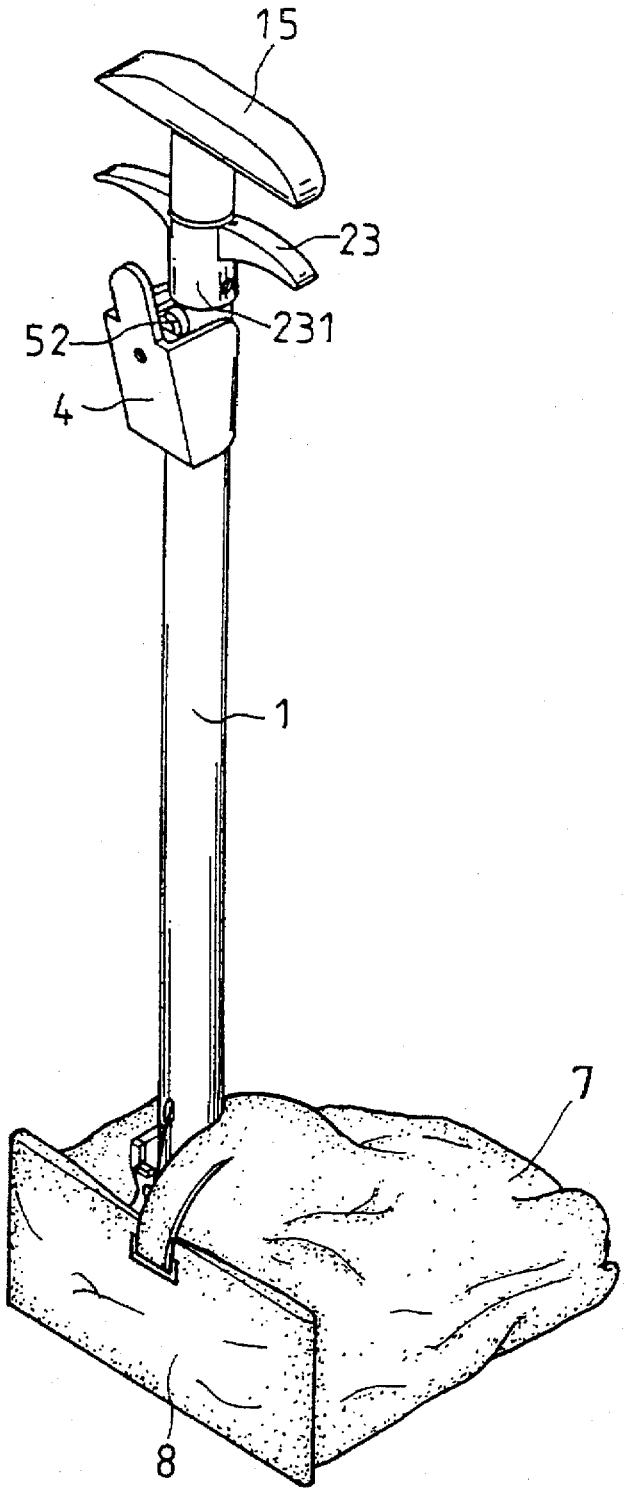
FIG. 1 is a perspective view of a refuse collecting device constructed in accordance with the present invention.
Figure 2:
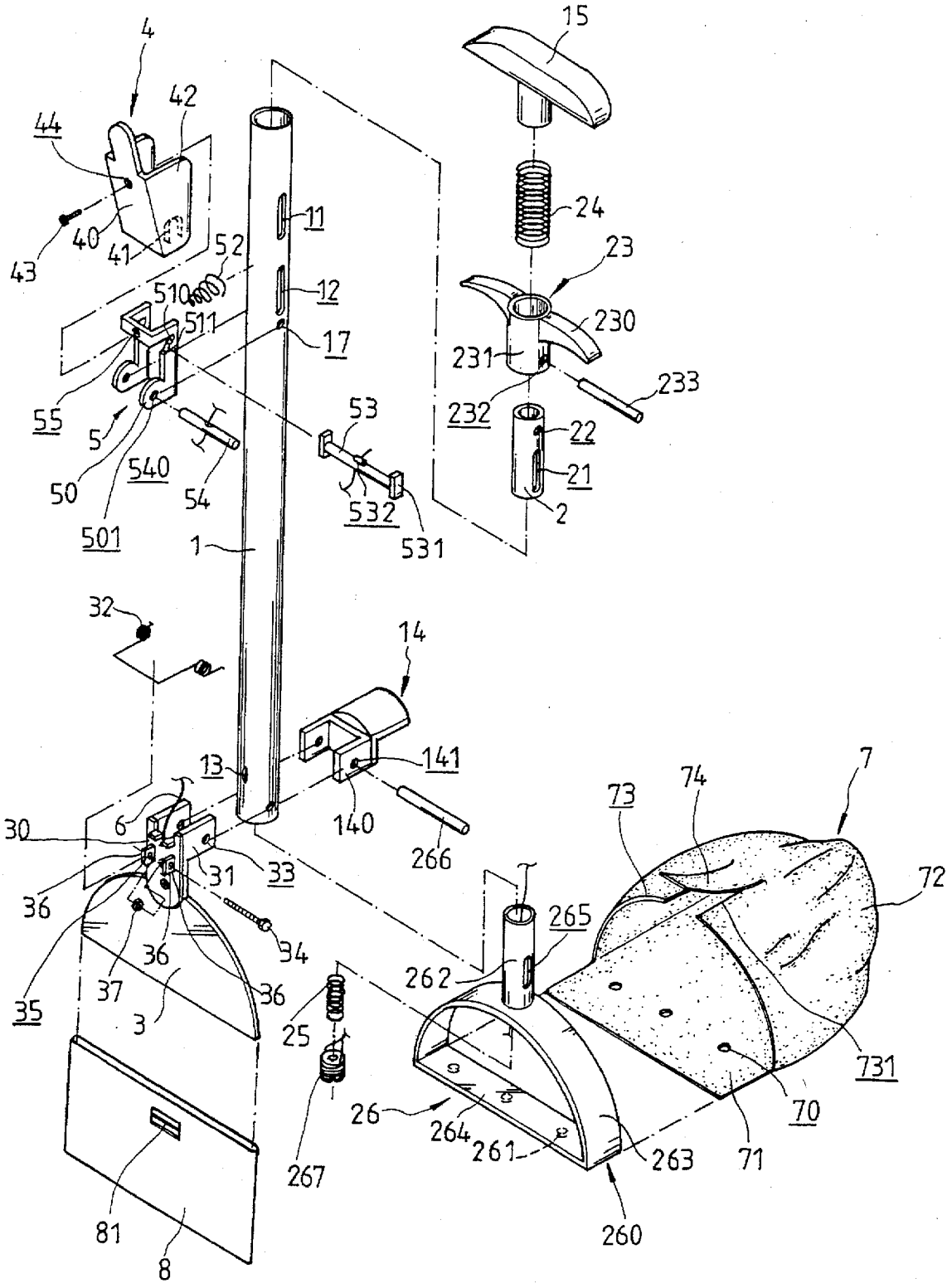
FIG. 2 is an exploded perspective view of the refuse collecting device.

With reference to the drawings and in particular to FIGS. 1 and 2, wherein a refuse collecting device constructed in accordance with the present invention is shown, the refuse collecting device of the present invention comprises an elongated tube 1 having a lower end in an axial direction thereof to which a bag mount 26 is movably received and an axial upper end to which a cap 15 is mounted. The refuse collecting device of the present invention further comprises a manual control comprising a grip 23 fit over and manually movable relative to the tube 1 and a positioning control device 5 which cooperates with the grip 23 to define a paddle closed position, a paddle open position and a bag released position to be further described.

A paddle 3 is pivoted to the lower end of the tube 1 to be movable between a paddle closed position and a paddle open position corresponding to those defined by the positioning control device 5. Both the paddle 3 and the bag mount 26 are connected to the grip 23 by means of wires 6 and 61, see FIGS. 3–5, to be operated thereby.

The bag mount 26 comprises a frame 260 to which a bag 7 is to be mounted. Preferably, the frame 260 is in the form of a half moon having a semi-circular upper section 263 and a flat lower section 264, the lower section 264 being adapted to be placed on the ground. The semi-circular upper section 263 comprises an upright cylindrical member 262 extending upward therefrom substantially at a center thereof. The cylindrical member 262 is slidably received within the lower end of the tube 1. To provide a smooth sliding motion of the cylindrical member 262 within the tube 1, preferably, the cylindrical member 262 has a sufficient length which should be determined practically and in accordance with the manufacturing process. The wire 61 that extends within and through the tube 1 is secured to the cylindrical member 262 of the bag mount 7 so as to drive the cylindrical member 262 to move within the tube 1.

Preferably, adjusting means, such as a bolt 267, is provided to adjust the tension or slackness of the wire 61. The bolt 267 is threadingly received within an inner-threaded hole 268 formed on the frame 260 and extending into the cylindrical member 262 which in this case is a hollow member. The wire 61 is secured to the bolt 267 so that by rotating the bolt 267 relative to the inner-threaded hole 268 of the frame 260, the tension or slackness of the wire 61 is adjusted.

An elongated, axially extending slot 265 is formed on the cylindrical member 265 through which a pin 266 extend. The pin 266 also extends through two diametrically opposite holes 16 formed in the proximity of the lower end of the tube 1 so as to maintain the cylindrical member 262 of the bag mount 26 within the tube 1 in a relatively moveable manner. The slot 265 has an axial length which defines the distance that the bag mount 26 is allowed to travel relative to the tube 1 so that the bag mount 26 is movable relative to the tube 1 between an inward (bag released) position (FIG. 5) and an outward (bag expanded) position (FIG. 3), respectively, defined by axially upper and lower ends of the slot 265.

Biasing means, such as a helical spring 25, is provided between the tube 1 and the bag mount 26 to bias the bag mount 26 toward the outward, bag expanded position. In the embodiment illustrated, the cylindrical member 262 is hollow and the helical spring 25 is received therein and arranged between the bolt 267 and the pin 266. The wire 61 extends through the spring 25 to connect to the adjusting bolt 267.

The flat section 264 of the frame 260 comprises a plurality of bosses 261 formed on an underside thereof. The bag 7 comprises a plurality of holes 70 corresponding to and receivable on the bosses 261. The tube 1 further comprises a bag support 14 which is pivoted or mounted to the tube 1 by means of the pin 266 or may be otherwise fixed to the tube 1. In the example shown, the bag support 14 is provided with two opposite and spaced walls 140 adapted to fit over the tube 1, each of the walls 140 having a hole 141 so that the pin 266 is allowed to extend through the holes 141 to secure the bag support 14 to the tube 1. The bag support 14 may be further secured to the tube 1 by means of, for example, welding.

In mounting the bag 7 to the refuse collecting device of the present invention, in addition to fitting the holes 70 onto the bosses 261, the side of the bag 7 that is opposite to the holes 70 is placed and supported on the bag support 14 when the bag mount 26 is in the bag released position with the spring 25 compressed. By releasing the bag mount 26 to allow it to be moved to the outward position by the restoration of the compressed spring 25, the bag 7 is expanded and firmly secured between the bag mount 26 and the bag support 14 with the frame 260 defining an opening 73 of the bag 7 through which refuse (not shown) may be received. The bag 7 will be further discussed hereinafter.

A paddle or lid 3 having a shape corresponding to the frame 260, namely a half moon shape that has an arcuate or semi-circular upper edge and a flat bottom edge, is also pivoted to the tube 1 by means of the pin 266. The paddle 3 comprises an extension 30 mounted to the arcuate upper edge and extending upward therefrom. The extension 30 has two laterally extending walls 31 which are spaced so as to laterally fit over the tube 1. The walls 31 have holes 33 through which the pin 266 extends to pivot the paddle 3 to the tube 1. Preferably, the walls 31 of the paddle 3 are fit over to be located outside and in sliding contact engagement with the walls 140 of the bag support 14 so that a smooth rotation of the paddle 3 about the pin 266 is ensured. Biasing means, such as torsional spring 32, is provided between the paddle 3 and the tube 1 to bias the paddle 3 to the closed position where the paddle 3 is in engagement with the frame 260 and thus shield and close the opening 73 of the bag 7 defined by the frame 260.

The wire 6 that is disposed within the tube 1 has a lower end extending through a hole 13 formed on the tube 1 to secure to the extension 30 of the paddle 3 so that when the wire 6 is pulled, the paddle 3 is rotated about the pin 266 against the biasing means 32 from the closed position to the open position where the opening 73 of the bag 7 expanded by the frame 260 is uncovered or opened for the entry of the refuse.

Preferably, adjusting means, such as a spool 34, is provided to adjust the tension or slackness of the wire 6. The spool 34 comprises a threaded section threadingly engaging two spaced lugs 36 which are fixed to the extension 30 of the paddle 3 and each has an inner-threaded hole 35 formed thereon to receive the threaded section therein. The wire 6 is wound around the portion of the spool 34 between the two spaced lugs 36 so that by rotating the spool 34, the wire 6 is wound and un-wound on the winding section of the spool 34 and thus the tension or slackness of the wire 6 is adjusted. Preferably, a nut 37 is provided to secure the spool 34 in position.

The grip 23 comprises a tubular section 231 slidably fit over the tube 1 with two wings 230 laterally extending therefrom in opposite directions for hand holding. The tubular section 231 has two diametrically opposite holes 232 through which a pin 233 extends. The tube 1 has two diametrically opposite, axially elongated slots 11 formed thereon through which the pin 233 also extends. The axial length of the slots 11 provides a distance for the grip 23 to travel relative to the tube 1 between an upper position and a lower position through an intermediate position between the upper position and the lower position.

A cylinder 2 is slidably received within the upper end of the tube 1. The cylinder 2 has a through hole 22 extending diametrically to allow the pin 233 to fit therein. This allows the cylinder 2 to be axially movable in unison with the grip 23 relative to the tube 1. The tube 1 has two further diametrically opposite, axially elongated slots 12 formed thereon and, corresponding thereto, the cylinder 2 is provided with a slot 21 so that a positioning pin 53 is allowed to extend through both the slots 12 of the tube 1 and the slot 21 of the cylinder 2. The slot 21 is dimensioned so that when the cylinder 2 is moved by the grip 23, the positioning pin 53 is also moved, although it may not be in unison therewith.

The length of the slots 21 accommodates the movement of the positioning pin 53 with the cylinder 2 and the grip 23.

The positioning pin 53 has a central hole 532 formed thereon through which upper ends of the wires 61 and 6 are extending and fixed thereon so that the movement of the positioning pin 53 also moves the bag mount 26 via the wire 61 and the paddle 3 via the wire 6.

Figure 4:
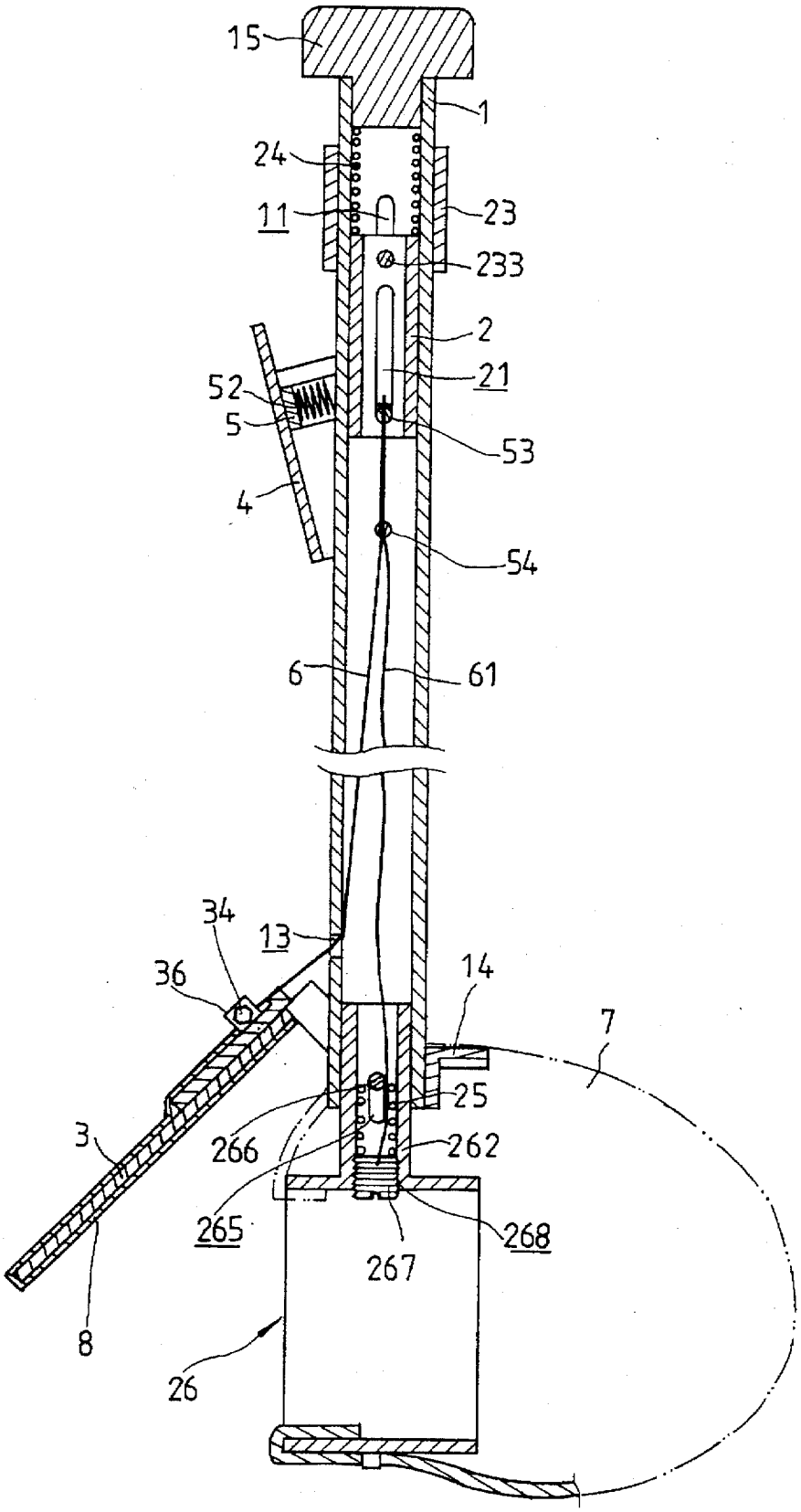
Figure 5:
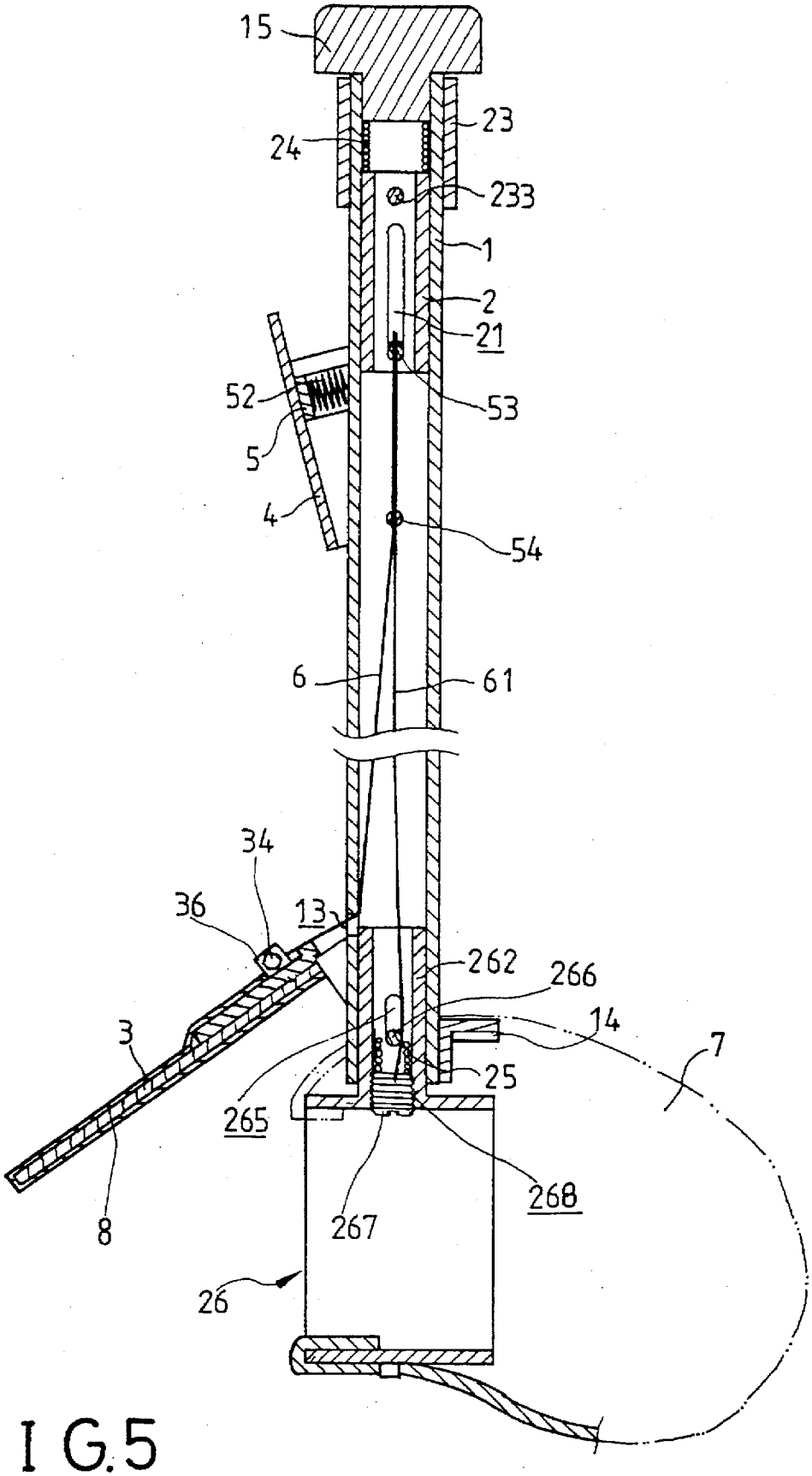

The wire 6 that connects the paddle 3 to the positioning pin 53 has a first length of slack and the wire 61 that connects the bag mount 26 to the positioning pin 53 has a second length of slack. In accordance with the present invention, the second slack is greater than the first slack and preferably the difference therebetween is corresponding to the distance between the intermediate position and the upper position of the cylinder 2 and the grip 23 so that when the cylinder 2 which is biased by the spring 24 to the lower position (FIG. 3) is moved upward against the spring 24 toward the intermediate position (FIG. 4), the positioning pin 53 is moved to such a position where the wire 6 is substantially fully stretched and pulled to open the paddle 3 from the paddle closed position toward the paddle open position (FIG. 4). When the positioning pin 53 is further moved upward with the cylinder 2 toward the upper position of the cylinder 2, the wire 61 is stretched and pulled, forcing the bag mount 26 to move toward the bag released position and get closer to the bag support 14 (FIG. 5). The reduction in distance between the bag mount 26 and the bag support 14 allows the bag 7 to be released therefrom.

The positioning pin 53 is provided with two expanded ends 531 which are preferably in the form of rectangular plates having a width movable through the slots 12 of the tube 1 and the slot 21 of the cylinder 2, but having a length greater than the width and not movable through the slots 12 and 21 so that the pin 53 is receivable through the slots 12 of the tube 1 and the slot 21 of the cylinder 2 when it is in a first orientation and when the pin 53, after being inserted through the slots 12 and 21, is rotated, for example, 90 degrees to a second orientation, the length thereof prevents the positioning pin 53 from disengaging from the slots 12 and 21 by being in contact engagement with the tube 1. At least in this respect, the slot 21 of the cylinder 2 has to be elongated to allow the pin 53 to insert therethrough in the first orientation.

It is, however, possible to provide the end plates 531 in a releasable manner, for example, the two ends of the positioning pin 53 may be threaded and the end plates 531 that have large dimension with an inner threaded hole formed thereon are threadingly mounted to the two threaded ends of the positioning pin 53. As an alternative, the end plates 531 may simply be welded to two ends of the positioning pin 53 when the pin is already received within the slots 12 and 21. In these ways, the slot 21 of the cylinder 2 may not be elongated.

Figure 3:
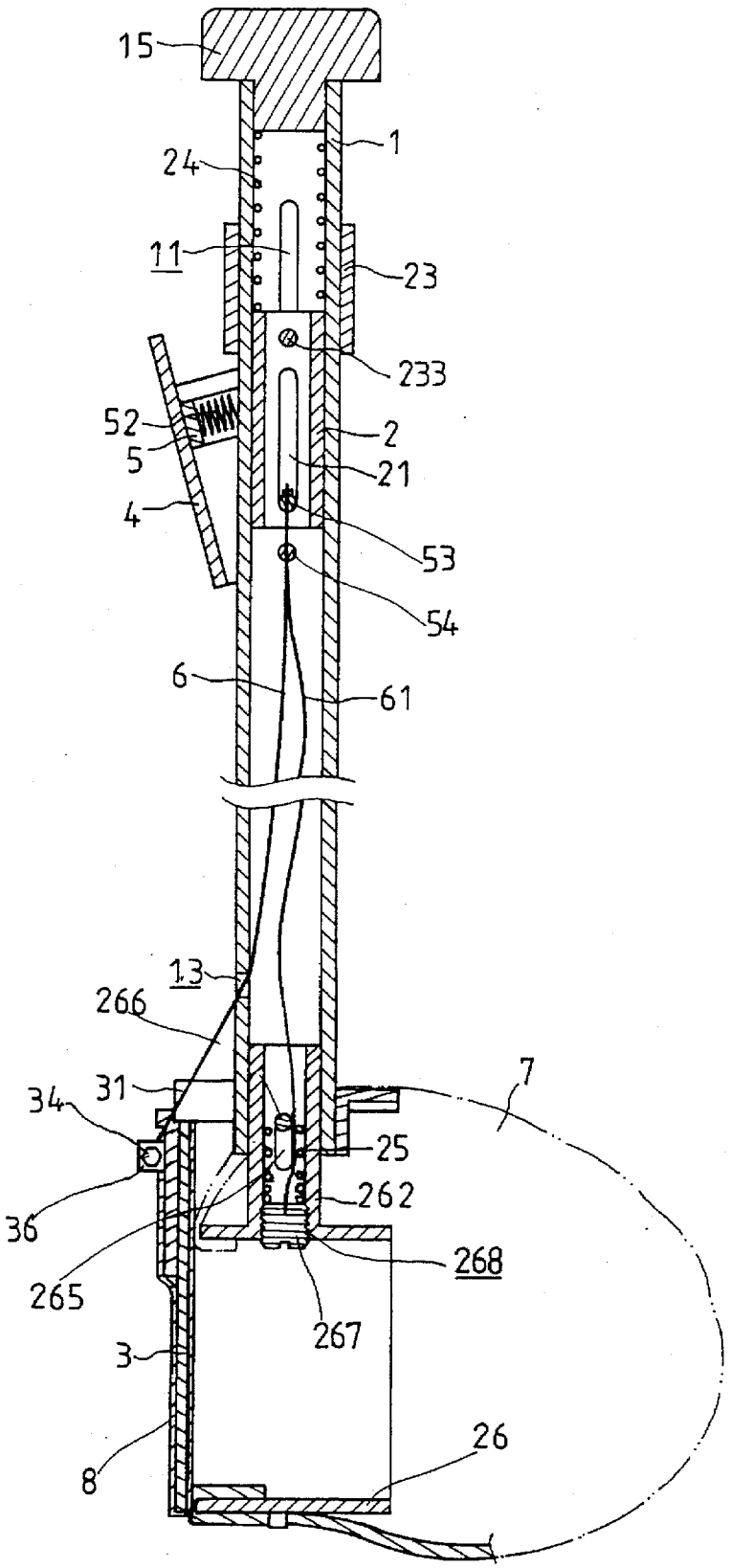
FIGS. 3–5 are cross-sectional views, respectively showing the paddle closed condition, the paddle open condition and the bag released condition of the refuse collecting device.

Biasing means, such as a helical spring 24, is provided inside the tube 1 to bias the cylinder 2, together with the grip 23, toward the lower position, where the wire 6 is released to allow the paddle 3 to move, under the action of the biasing means 32, toward the paddle closed position, FIG. 3. In the embodiment illustrated, the helical spring 24 has an end abutting against the cap 15 and an opposite end supported on the cylinder 2.

The positioning control device 5 comprises two spaced walls 50 to fit over the tube 1. The walls 50 have holes 501 formed thereon, corresponding to two diametrically opposite holes 17 that are formed on the tube 1 and located lower than the slots 12 in the axial direction. A pin 54 extends through holes 501 and 17 to pivot the positioning control device 5 to the tube 1. Preferably, the pivot pin 54 has a lateral hole 540 through which the wires 6 and 61 extend.

Each of the walls 50 of the positioning control device 5 has a recess 51 to accommodate the positioning pin 53 to extend therethrough. The recess 51 comprises two stages, a lower stage 511 and an upper stage 510. The lower stage 511 corresponds to the intermediate position of the cylinder 2 and the upper stage 510 corresponds to the upper position of the cylinder 2.

Each of the two stages 510 and 511 is provided with a configuration to retain the positioning pin 53 therein so as to maintain the refuse collecting device in the paddle open position and the bag released position, respectively This may be achieved by providing each stage with a step-like configuration having a substantially horizontal face followed by a substantially vertical face so that when biasing means, such as a helical spring 52, is provided between the tube 1 and the positioning control device 5 to bias the positioning control device 5 to rotate away from the tube 1 about the pivot pin 54 and thus force the positioning pin 53 against the vertical faces of the stages 511 and 510 when the positioning pin 53 is moved to one of the stages 510 and 511, the positioning pin 53 is held and supported on the horizontal faces.

With such a step-like configuration of the stages 511 and 510, by rotating the positioning control device 5, against the spring 52, toward the tube 1, the positioning pin 53 is forced to move out of the stages 510 and 511 so as to release the positioning pin 53.

Another purpose of the end plates 531 is to guide the movement of the positioning pin 53 and the inner cylinder 2 within the tube 1. In this respect, positioning pin 53 and the end plates 531 are configured so that the end plates 531 are located outside and in sliding contact engagement with the walls 50 of the positioning control device 5 for sliding along outside surfaces of the walls 50 when the positioning pin 53 and the inner cylinder 2 are moved within the tube 1.

A lid 4 is provided to shield the positioning control device 5 and to prevent the positioning control device 5 which may have sharp edges or tips from damaging the user's hand. The lid 4 comprises a plate member 40 having two opposite and spaced walls 42 extending from opposite edges thereof to fit over the tube 1. Inside each of the walls 42, a groove 41 is formed for accommodating two exposed ends of the pivot pin 54 therein which form a pivotal connection between the lid 4 and the tube 1 to allow the lid 4 to be manually rotated toward the tube 1 about the pivot pin 54. The movement of the lid 4 toward the tube 1 forces the positioning control device 5 to move against the spring 52 and thus eventually release the positioning pin 53 from the stages 511 or 510.

The grooves 41 inside the walls 42 are configured to extend to lower edges of the walls 42 so as to allow the grooves 41 to be readily fit over the exposed ends of the pivot pin 54. This simplifies the manufacturing process.

Preferably, the lid 4 and the positioning control device 5 are secured together by means of a fastener, such as a bolt 43 which threadingly engages a threaded hole 44 of the lid 4 and a threaded hole 55 of the positioning control device 5. Alternately, the holes 44 and 55 may not need to be threaded and instead, a nut (not shown) is provided to tighten the bolt 43 to the lid 4 and the positioning control device 5.

In accordance with the present invention, the bag 7 comprises a body 72 having an opening 73 with an extension 71 formed on one side thereof. The holes 70 to be fit onto the bosses 261 formed on the underside of the frame 260 of the bag mount 26 are provided on the extension 71. In mounting the bag 7 to the bag mount 26, one may fit the holes 70 onto the bosses 261 with the extension 71 underlapping the flat section 264 of the frame 260 and when the bag mount 26 is located at the inward bag released position, one may place the side of the bag opening 73 that is opposite to the holes 70 on the bag support 14 of the tube 1. By allowing the bag mount 26 to move under the action of the spring 25 to the bag expanded position, the bag opening 73 is opened by the frame 260 and firmly held thereon.

Preferably, the extension 71 is dimensioned so as to fold back along the flat section 264 of the frame 260 and overlap it, as shown in FIGS. 3–5. More preferably, the bag opening 73 is configured to not only overlap the flat section 264, but also the semi-circular section 263 as shown in FIGS. 3–5. This protects the frame 260 from being soiled by the refuse collected.

In accordance with an aspect of the present invention, a paddle cover or enclosure 8 is provided to fit over the paddle 3 from the underside. To secure the cover 8 in position, fastening means is provided on the cover 8. In the embodiment illustrated, the fastening means comprises adhesive material, such as double-face coated adhesive pad 81. The bag 7 is provided with a strip 74 substantially extending from the side of the bag opening 73 that is opposite to the holes 70 toward the adhesive pad 81 of the cover 8. The strip 74 has a length sufficient to extend over the bag support 14 and around the tube 1 to connect to the pad 81. Of course, fastening means of different type may also be used, such as Velcro material.

Preferably, the bag opening 73 is provided with a notch 731 from which the strip 74 extends. The notch 731 allows the bag opening 73 to accommodate the tube 1 within the notch 731 so as to allow the bag opening 73 to snugly overlap the semi-circular section 263 of the frame 260.

In removing the bag 7, together with the paddle cover 8, from the refuse collecting device, one can move the grip 23 to the upper position which drives the bag mount 26 to the bag released position. Under this situation, by gently shaking the refuse collecting device, the bag 7 will automatically disengage from the bag mount 26 due to the gravity of the bag itself and that of the refuse collected therein. Then, by suitably rotating the refuse collecting device to allow the strip 73 to disengage from the refuse collecting device and orient the paddle 3 is such a direction to allow the cover 8 to fall down with the bag 7. No hand touching the bag and the cover is needed.

Although a preferred embodiment has been described to illustrate the present invention, it is apparent that changes and modifications in the specifically described embodiment can be carried out without departing from the scope of the invention which is intended to be limited only by the appended claims.

What is claimed is:

1. A refuse collecting device comprising:

an elongated tube having an upper axial end and a lower axial end, a bag support being attached to the tube in the proximity of the lower end and sideways projected therefrom;

a bag mount comprising a frame and a cylindrical member extending from the frame to be movably received within the lower end of the tube between an inward bag released position and an outward bag expanded position, the frame comprising a plurality of bosses on an underside, the bag mount comprising first biasing means to bias the bag mount to the outward position;

a bag having a body with an opening, the opening having a plurality of holes formed on one side thereof corresponding to and fit onto the bosses, the bag opening having dimension that when the bag mount is in the inward position, an opposite side of the bag opening is engageable and supported on the bag support and when the bag mount is moved to the outward position, the bag opening is expanded and thus firmly held between the bag support and the bag mount;

a paddle having a shape corresponding to the frame of the bag mount and rotatably attached to the tube to be movable between a closed position where the paddle shields and covers the frame and thus the opening of the bag and an open position where the paddle is located away from the frame to expose the bag opening, the paddle comprising second biasing means to bias the paddle to the closed position;

an inner cylinder received and moveable within the tube between a lower position and an upper position via an intermediate position therebetween, the inner cylinder comprising third biasing means to bias the inner cylinder toward the lower position;

a first wire having an end fixed to the paddle and an opposite end fixed to the inner cylinder, the first wire having a first length of slack so that when the inner cylinder is in the lower position, the paddle is allowed to be biased by the second biasing means to the closed position and when the inner cylinder is moved, against the third biasing means, from the lower position to the intermediate position, the first length of slack is stretched and the paddle is forced by the first wire to rotate against the second biasing means and relative to the tube to the open position;

a second wire having an end fixed to the tubular member of the bag mount and an opposite end fixed to the inner cylinder, the second wire having a second length of slack so that when the inner cylinder is in the lower position and the intermediate position, the bag mount is allowed to be biased by the first biasing means to the outward position to expand and firmly hold the bag and when the inner cylinder is moved against the third biasing means to the upper position, the second length of slack is stretched and the bag mount is forced by the second wire to move against the first biasing means and relative to the tube to the inward position; and a cylindrical hand grip fit over the tube in a manually movable manner and coupled to the inner cylinder for moving the inner cylinder therewith between the lower position and the upper position.

2. The refuse collecting device as claimed in claim 1, wherein the cylindrical member of the bag mount comprises an axially elongated slot formed thereon and having an upper end and a lower end defining therebetween an axial length of the slot, the tube comprises two diametrically opposite holes through which a pin extends, the pin also extending through the slot of the bag mount so that the movement of the bag mount relative to the tube is limited by the upper end of the axially elongated slot which defines the inward position of the bag mount and the lower end of the axially elongated slot which defines the outward position of the bag mount.

3. The refuse collecting device as claimed in claim 1, wherein the first biasing means comprises a helical spring disposed within the tube with one end fixed to the bag mount and an opposite end fixed to the tube.

4. The refuse collecting device as claimed in claim 1, wherein the second biasing means comprises a torsional spring disposed between the paddle and the tube.

5. The refuse collecting device as claimed in claim 1, wherein the inner cylinder comprises a transverse hole, wherein the cylindrical grip comprises two diametrically opposite holes and wherein the tube comprises two first, diametrically opposite, axially elongated slots, a pin extending through the holes of the cylindrical grip, the slots of the tube and the hole of the inner cylinder to couple the inner cylinder to the cylindrical grip in a manner to be axially movable together relative to the tube, the first axially elongated slots of the tube having an axial upper end and an axial lower end respectively defining the upper and lower positions of the inner cylinder by having the pin contacting the upper and lower ends of the slots.

6. The refuse collecting device as claimed in claim 1, wherein the third biasing means comprises a helical spring disposed within the tube and having an end supported on the inner cylinder and an opposite end fixed to the tube.

7. The refuse collecting device as claimed in claim 1, wherein the tube comprises a cap tightly fit into the upper end thereof and wherein the third biasing means comprises a helical spring disposed within the tube and arranged between the cap and the inner cylinder.

8. The refuse collecting device as claimed in claim 1, further comprising positioning control means for retaining the inner cylinder in the intermediate position and the upper position against the third biasing means.

9. The refuse collecting device as claimed in claim 8, wherein the positioning control means comprises a positioning pin laterally extending through two second, diametrically opposite, axially elongated slots formed on the tube with two ends of the positioning pin extending outside the tube and a control member having two spaced walls fit over and pivoted to the tube by means of a pivot pin, the positioning pin also extending through a slot formed on the inner cylinder so as to be moved thereby when the inner cylinder is moved between the upper and lower positions relative to the tube, the control member having a two stage configuration comprising a lower stage and an upper stage to receive and retain the ends of the positioning pin thereon, the two stages being dimensioned and located so that when the inner cylinder is moved from the lower position toward the intermediate position, the control member is movable relative to the positioning pin to receive and hold the positioning pin on the lower stage and when the inner cylinder is moved from the intermediate position toward the upper position, the positioning pin is movable to receive and hold the positioning pin on the upper stage.

10. The refuse collecting device as claimed in claim 9, wherein each of the two stages of the control member comprises a substantially horizontal face followed by a vertical face and wherein the control member is spring-biased so as to have the positioning pin that is received in the horizontal face of the stage to lie against the vertical face.

11. The refuse collecting device as claimed in claim 10, further comprising a release member pivoted to the tube and coupled to the control member to allow manual movement of the control member against the biasing spring and thus forcing the positioning pin to slide out of and disengage from the horizontal face of the stage so as to release the positioning pin from the stage.

12. The refuse collecting device as claimed in claim 11, wherein the pivot pin for pivoting the control member to the tube has two ends extending out of the tube and wherein the release member comprises two opposite, spaced walls fit over the tube, each of the walls having a slot extending to a lower edge thereof so as to define an entry opening for slidably fitting over the ends of the pivot pin for pivoting the release member to the tube.

13. The refuse collecting device as claimed in claim 9, wherein the positioning pin comprises a central hole through which ends of the wires are extending and fixed.

14. The refuse collecting device as claimed in claim 9, wherein each of the two ends of the positioning pin that extend outside the tube comprises an expanded portion located outside and in sliding contact engagement with the walls of the control member so as to retain the positioning pin within the second elongated slots of the tube and guide the movement of the inner cylinder within the tube.

15. The refuse collecting device as claimed in claim 1, further comprising a paddle cover releasably fit over the paddle and fixed in position by means of fastening means.

16. The refuse collecting device as claimed in claim 15, wherein the fastening means comprises a strip extending from the opposite side of the bag opening to attach to an adhesive pad provided on the paddle cover so as to hold the paddle cover in position.

17. The refuse collecting device as claimed in claim 1, wherein the bag comprises an extension provided on the side of the bag opening on which the holes are formed, the extension having a length sufficient to be folded back to overlap a portion of the frame of the bag mount.

18. The refuse collecting device as claimed in claim 17, wherein the bag opening is configured to overlap the frame of the bag mount along a circumference of the frame.

19. The refuse collecting device as claimed in claim 1, wherein the frame of the bag mount comprises a half moon shape having a flat bottom section with the bosses formed on an underside thereof and a semi-circular top section with the cylindrical member of the frame provided thereon.

20. The refuse collecting device as claimed in claim 1, wherein both the first and second wires are provided with means for adjusting the length of slack thereof.

* * * * *